US010228175B2

(12) United States Patent
Kita et al.

(10) Patent No.: US 10,228,175 B2
(45) Date of Patent: Mar. 12, 2019

(54) LIQUID TEMPERATURE CONTROL APPARATUS AND TEMPERATURE CONTROL SYSTEM

(71) Applicant: Shinwa Controls Co., Ltd., Kawasaki-Shi (JP)

(72) Inventors: Takafumi Kita, Kawasaki (JP); Kazutomo Ichinoki, Kawasaki (JP); Katsuji Uchino, Kawasaki (JP)

(73) Assignee: Shinwa Controls Co., Ltd., Kawasaki-shi (JP)

( * ) Notice: Subject to any disclaimer, the term of this patent is extended or adjusted under 35 U.S.C. 154(b) by 0 days.

(21) Appl. No.: 15/567,206

(22) PCT Filed: Aug. 22, 2017

(86) PCT No.: PCT/JP2017/029987
§ 371 (c)(1),
(2) Date: Oct. 17, 2017

(87) PCT Pub. No.: WO2018/051745
PCT Pub. Date: Mar. 22, 2018

(65) Prior Publication Data

US 2018/0231291 A1 Aug. 16, 2018

(30) Foreign Application Priority Data

Sep. 14, 2016 (JP) ..... 2016-179767

(51) Int. Cl.
*F25B 49/02* (2006.01)
*F25B 5/02* (2006.01)
(Continued)

(52) U.S. Cl.
CPC ..... *F25B 49/022* (2013.01); *F25B 1/06* (2013.01); *F25B 5/02* (2013.01); *F25B 6/00* (2013.01);
(Continued)

(58) Field of Classification Search
CPC .. F25B 5/02; F25B 6/00; F25B 25/005; F25B 29/003; F25B 49/02; F25B 49/022; F25B 2400/0403; F25B 2600/2501; H05B 3/00
See application file for complete search history.

(56) References Cited

U.S. PATENT DOCUMENTS 5,727,393 A * 3/1998 Mahmoudzadeh ..... F25D 17/02 62/156

FOREIGN PATENT DOCUMENTS

JP 2006-038323 A1 2/2006

* cited by examiner

*Primary Examiner* — Marc E Norman
(74) *Attorney, Agent, or Firm* — Burr & Brown, PLLC

(57) ABSTRACT

A liquid temperature control apparatus including a heat medium circulation apparatus equipped with a cooling unit having a compressor, a condenser, an expansion valve, and a plurality of cooling heat exchangers, and equipped with a heating unit configured to allow a portion of a heat medium flowing out from the compressor toward the condenser to be branched and return the portion of the heat medium to flow into the condenser on the downstream side of the compressor via a heating heat exchanger and a heating amount adjustment valve; and a liquid flow apparatus. A first liquid flow path of the liquid flow apparatus is connected to the first cooling heat exchanger and to the heating heat exchanger. A second liquid flow path is connected to the second cooling heat exchanger. Moreover, an electric heater for heating the liquid allowed to flow is provided in the second liquid flow path.

7 Claims, 3 Drawing Sheets

(51) Int. Cl.

| | |
|---|---|
| ***H05B 3/00*** | (2006.01) |
| ***F25B 1/06*** | (2006.01) |
| ***F25B 29/00*** | (2006.01) |
| ***F25B 6/00*** | (2006.01) |
| ***F25B 25/00*** | (2006.01) |
| *H05B 3/02* | (2006.01) |

(52) U.S. Cl.

CPC ..... *F25B 25/005* (2013.01); *F25B 29/003* (2013.01); *F25B 49/02* (2013.01); *H05B 3/00* (2013.01); *F25B 2313/0314* (2013.01); *F25B 2339/047* (2013.01); *F25B 2400/0403* (2013.01); *F25B 2600/2501* (2013.01); *F25B 2700/21161* (2013.01); *H05B 3/0014* (2013.01); *H05B 3/026* (2013.01)

LIQUID TEMPERATURE CONTROL APPARATUS AND TEMPERATURE CONTROL SYSTEM

TECHNICAL FIELD

The present invention relates to a liquid temperature control apparatus for controlling the temperature control target by a liquid, and a temperature control system including the same.

BACKGROUND ART

There is a known liquid temperature control apparatus including a cooling apparatus having a compressor, a condenser, an expansion valve and an evaporator, and including a circulation apparatus for circulating a liquid such as brine, and configured to cool a liquid in the circulation apparatus by the evaporator of the cooling apparatus (refer to Patent Literature 1, for example). In such a liquid temperature control apparatus, the circulation apparatus includes a heater for heating the liquid, in usual cases. This enables the liquid to be cooled and heated, and thus, enables the temperature of the liquid to be accurately controlled to a desired temperature.

CITATION LIST

Patent Literature

Patent Literature 1: JP 2006-38323 A

SUMMARY OF INVENTION

Technical Problem

In the liquid temperature control apparatus as described above, there is a need to supply the liquid of the circulation apparatus to a plurality of temperature control target in some cases. In this case, a plurality of evaporators may be provided in parallel in the cooling apparatus, and the circulation apparatuses corresponding to the number of evaporators may be provided. Such a mode is useful in that the size of the cooling apparatus can be suppressed and thus, the installation space of the cooling apparatus can be suppressed as compared with the case where a plurality of circulation apparatuses is provided for a plurality of cooling apparatuses.

The above-described mode, however, is not able to sufficiently achieve suppression of the manufacturing cost of the circulation apparatus and simplification of apparatus configuration. In particular, providing a heater in each of the circulation apparatuses might undesirably increase the manufacturing cost and the energy cost. Specifically, while a typical circulation apparatus uses an electric heater capable of heating liquids with high accuracy, it is not always necessary to supply a highly accurately temperature-controlled liquid to all of a plurality of temperature control targets in a case where the liquid is supplied to the plurality of temperature control objects. In such a situation, a mode of providing a plurality of evaporators in the cooling apparatus and providing a plurality of electric heaters corresponding to each of the evaporators would undesirably increase the manufacturing cost and undesirably increase the energy cost.

The present invention has been made in view of such a circumstance, and is intended to provide a liquid temperature control apparatus and a temperature control system capable of supplying a temperature-controlled liquid to a plurality of temperature control targets while suppressing manufacturing costs and energy costs.

Solution to Problem

The present invention relates to a liquid temperature control apparatus including: a heat medium circulation apparatus equipped with a cooling unit in which a compressor, a condenser, an expansion valve, and a plurality of cooling heat exchangers are connected by pipes in this order so as to circulate a heat medium, and equipped with a heating unit configured to allow a portion of the heat medium flowing out from the compressor to the condenser to be branched and return the heat medium so as to flow into the condenser on a downstream side of the compressor via a heating heat exchanger and a heating amount adjustment valve; and a liquid flow apparatus including a plurality of liquid flow paths to allow the liquid to flow, in which a first liquid flow path among the plurality of liquid flow paths is connected to a first cooling heat exchanger so as to enable heat exchange between the liquid that is allowed to flow and the heat medium that flows through the first cooling heat exchanger among the plurality of cooling heat exchangers, while being connected to the heating heat exchanger so as to enable heat exchange between the liquid allowed to flow and the heat medium that flows through the heating heat exchanger, a second liquid flow path among the plurality of liquid flow paths is connected to a second cooling heat exchanger so as to enable heat exchange between the liquid allowed to flow and the heat medium that flows through the second cooling heat exchanger among the plurality of cooling heat exchangers, and an electric heater for heating the liquid allowed to flow is provided in the second liquid flow path.

According to the liquid temperature control apparatus of the present invention, it is possible to supply a liquid to different temperature control targets from the first liquid flow path and the second liquid flow path. Cooling of the liquid flowing through the second liquid flow path is performed by heat exchange between the liquid and the heat medium flowing through the second cooling heat exchanger of the cooling unit, and heating is performed by the electric heater. Moreover, cooling of the liquid flowing through the first liquid flow path is performed by heat exchange between the liquid and the heat medium flowing through the first cooling heat exchanger of the cooling unit, and heating is performed by heat exchange between the liquid and a portion of the heat medium that flows through the heating heat exchanger of the heating unit and that has been heated to a high temperature by the compressor of the cooling unit. The heating capacity of the heating heat exchanger at this time can be adjusted by the heating amount adjustment valve. In this configuration, heating is performed by utilizing the amount of heat generated in the cooling unit without connecting the heating heat exchanger to a dedicated power supply circuit, leading to suppression of the manufacturing cost and the energy cost. This makes it possible to supply a temperature-controlled liquid to a plurality of temperature control targets while suppressing the manufacturing cost and the energy cost.

In particular, the liquid temperature control apparatus according to the present invention performs heating of the liquid flowing through the first liquid flow path by utilizing a portion of the heat medium of the cooling unit. Moreover, heating of the liquid flowing through the second liquid flow path is performed by an electric heater. With this configuration, it is possible to select an application mode, for example, of supplying a liquid from the second liquid flow path to a temperature control target demanding supply of highly accurately temperature-controlled liquid. Accordingly, in a case, for example, where the liquid temperature control apparatus according to the present invention is applied to a situation in which there is no need to supply highly accurately temperature-controlled liquid to all the temperature control targets, it is possible to particularly effectively suppress the manufacturing cost and the energy cost.

The second liquid flow path may include a second main flow path including a connecting portion with the second cooling heat exchanger, between an upstream end and a downstream end of the second main flow path, and may include a plurality of second branch flow paths branching from the downstream end of the second main flow path, and the electric heater may be provided in each of the plurality of second branch flow paths.

This makes it possible to supply the liquid to the plurality of temperature control targets from the plurality of second branch flow paths, leading to achievement of expansion of an application scope of the liquid temperature control apparatus.

Moreover, the first liquid flow path may include a first main flow path including a connecting portion with the first cooling heat exchanger and the heating heat exchanger, between an upstream end and a downstream end of the first main flow path, and may include a plurality of first branch flow paths branching from a downstream end of the first main flow path.

This makes it possible to supply the liquid to the plurality of temperature control targets from the plurality of first branch flow paths, leading to achievement of expansion of an application scope of the liquid temperature control apparatus.

Moreover, the heating unit may have a plurality of flow paths configured to allow a portion of the heat medium flowing out from the compressor toward the condenser to be branched, and the heating heat exchanger and the heating amount adjustment valve may be provided in each of the plurality of flow paths.

This enables temperature control of the liquid by the plurality of heating heat exchangers and the heating amount adjustment valve, making it possible to increase patterns of the temperature control of the liquid.

Moreover, the liquid temperature control apparatus according to the present invention may further include a control apparatus configured to control at least the electric heater, and the control apparatus may control the electric heater via a solid state relay.

This stabilizes the control of the electric heater by utilizing the solid state relay, making it possible to perform highly accurate temperature control of the liquid flowing through the second liquid flow path.

Moreover, the expansion valve in the cooling unit may be provided on the upstream side of each of the plurality of cooling heat exchangers.

In this case, by separately controlling each of the expansion valves corresponding to each of the plurality of cooling heat exchangers, it is possible to separately adjust the refrigerating capacity of the plurality of cooling heat exchangers. With this configuration, by separately adjusting the refrigerating capacity of each of the cooling heat exchangers in accordance with the temperature of the liquid demanded by the temperature control target corresponding to each of the cooling heat exchangers, it is possible to perform efficient temperature control.

Advantageous Effect of Invention

According to the present invention, it is possible to supply the temperature-controlled liquid to a plurality of temperature control targets while suppressing the manufacturing cost and the energy cost.

DESCRIPTION OF EMBODIMENTS

Hereinafter, embodiments of the present invention will now be described in detail with reference to the accompanying drawings.

First Embodiment

Figure 1:
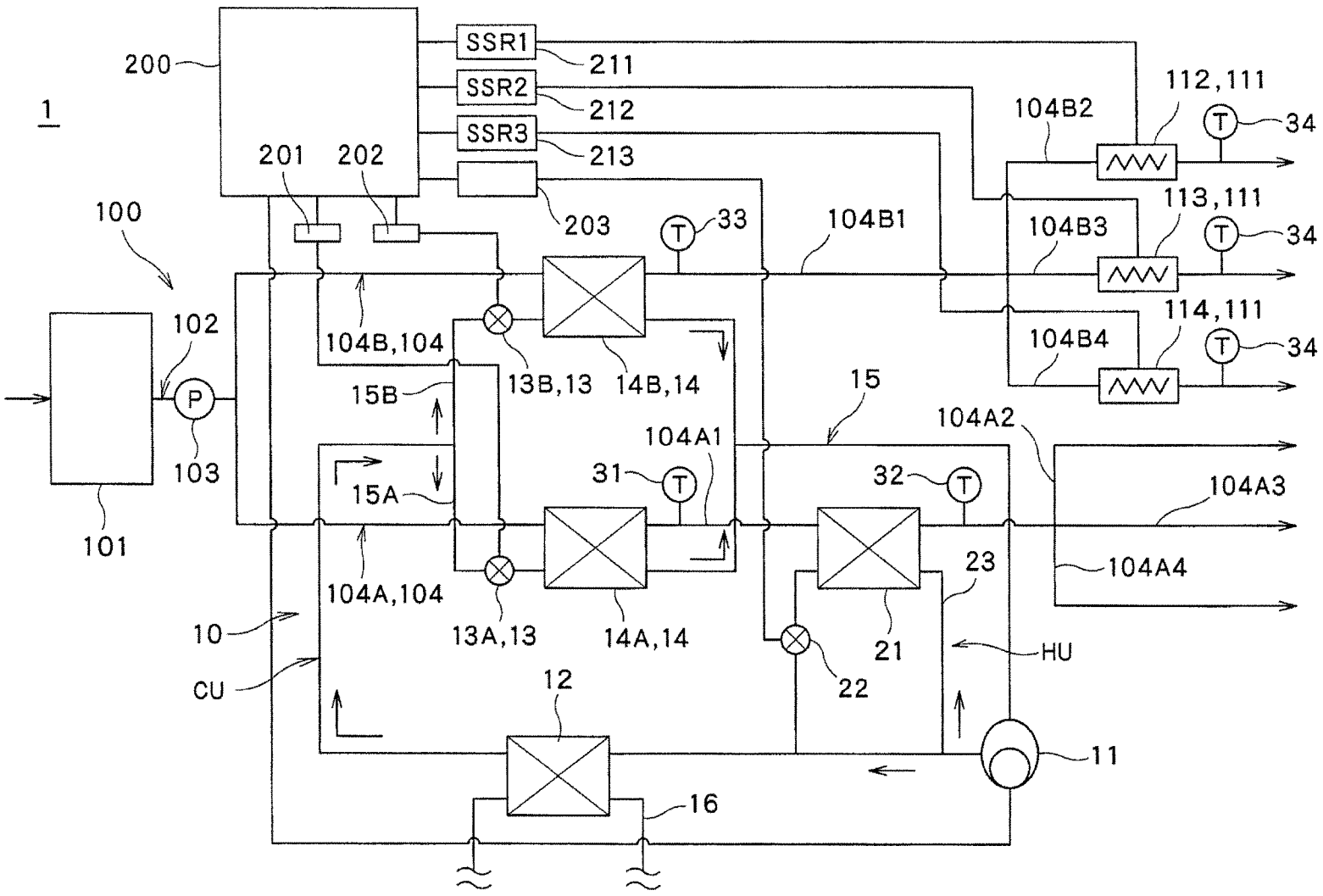
FIG. 1 is a schematic diagram of a liquid temperature control apparatus according to a first embodiment of the present invention.

FIG. 1 is a schematic diagram of a liquid temperature control apparatus 1 according to a first embodiment of the present invention. The liquid temperature control apparatus 1 illustrated in FIG. 1 includes a heat medium circulation apparatus 10, a liquid flow apparatus 100, and a control apparatus 200. The heat medium circulation apparatus 10 controls the temperature of the liquid flowing through the liquid flow apparatus 100 by the heat medium circulating inside the heat medium circulation apparatus 10, and the liquid flow apparatus 100 supplies the liquid temperature-controlled by the heat medium circulation apparatus 10 to the temperature control target. The liquid flowing through the liquid flow apparatus 100 is adjusted to a desired temperature by controlling the heat medium circulation apparatus 10 and the liquid flow apparatus 100 by the control apparatus 200.

The liquid temperature control apparatus 1 is capable of supplying the temperature-controlled liquid from the liquid flow apparatus 100 to a plurality of temperature control targets. The plurality of temperature control targets to which the liquid is supplied may be, for example, a plurality of processing apparatuses included in a semiconductor manufacturing facility. Moreover, the processing apparatus included in the semiconductor manufacturing facility may be an apparatus such as a photoresist coating apparatus, and a developing apparatus that develops photoresist, for example. Hereinafter, individual components of the liquid temperature control apparatus 1 will be described below.

(Heat Medium Circulation Apparatus)

First, the heat medium circulation apparatus 10 will be described. As illustrated in FIG. 1, the heat medium circulation apparatus 10 includes a cooling unit CU constituted with a compressor 11, a condenser 12, an expansion valve 13, and a plurality of cooling heat exchangers 14 being connected in this order by a pipe 15 so as to circulate a heat medium, and includes a heating unit HU configured to allow a portion of the heat medium flowing out from the compressor 11 toward the condenser 12 to be branched and return the portion of the heat medium to flow into the condenser 12 on the downstream side of the compressor 11 via the heating heat exchanger 21 and the heating amount adjustment valve 22 provided on the downstream side of the heating heat exchanger 21.

In the cooling unit CU, the compressor 11 is configured to compress the heat medium in a state of a low-temperature and low-pressure gas flowing out from the plurality of cooling heat exchangers 14 and supply the compressed heat medium as a state of high-temperature (for example, 80° C.) and high-pressure gas to the condenser 12. In the present embodiment, the compressor 11 is provided as an inverter compressor that is operated at a variable operation frequency, in which the rotation speed can be adjusted in accordance with the operation frequency. With this configuration, the higher the operation frequency of the compressor 11 raises, the more heat medium is supplied to the condenser 12. It is preferable to adopt, as the compressor 11, a scroll type compressor integrally including an inverter and a motor. While the compressor 11 according to the present embodiment can adjust the rotation speed, the compressor 11 may also be configured to operate at a fixed rotation speed at a constant operation frequency.

The heat medium compressed by the compressor 11 is condensed by the condenser 12 while cooled with cooling water, so as to be supplied to the expansion valve 13 in a state of a high-pressure liquid at a predetermined cooling temperature (for example, 40° C.). As the cooling water of the condenser 12, water or any other refrigerant may be used. In the figure, a reference numeral 16 denotes a cooling water pipe for supplying cooling water to the condenser 12. In addition, the expansion valve 13 expands the heat medium supplied from the condenser 12 so as to be decompressed and supplies the decompressed heat medium to the plurality of cooling heat exchangers 14 as a low-temperature (for example, 2° C.) and low-pressure gas-liquid mixed state.

In the present embodiment, the plurality of cooling heat exchangers 14 are arranged in parallel, and each of the cooling heat exchangers 14 allows the heat medium supplied from the expansion valve 13 to flow. Specifically, the pipe 15 includes a first branch portion 15A and a second branch portion 15B that branch to a plurality of branches (in this example in two branches) in the downstream side of the condenser 12 and thereafter merge with each other. A first cooling heat exchanger 14A of the plurality of cooling heat exchangers 14 is connected to the first branch portion 15A, while a second cooling heat exchanger 14B among the plurality of cooling heat exchangers 14 is connected to the second branch portion 15B. That is, one cooling heat exchanger 14 is connected to each of the plurality of branch portions 15A and 15B. Moreover, the expansion valve 13 includes a first expansion valve 13A and a second expansion valve 13B. The first expansion valve 13A is provided in the first branch portion 15A on the upstream side of the first cooling heat exchanger 14A, while the second expansion valve 13B is provided in the second branch portion 15B on the upstream side of the second cooling heat exchanger 14B.

As will be described in detail below, each of the plurality of cooling heat exchangers 14 performs heat exchange between the heat medium supplied from the corresponding expansion valve 13 and the liquid of the liquid flow apparatus 100. Here, the heat medium heat-exchanged with the liquid flows out in a state of low-temperature and low-pressure gas from each of the cooling heat exchangers 14 and is compressed again by the compressor 11. In the above-configured cooling unit CU, by adjusting the rotation speed of compressor 11 by changing the operation frequency thereof, it is possible to adjust the supply amount of the heat medium to be supplied to the condenser 12, and since the opening degree of the expansion valve 13 can be adjusted, it is possible to adjust the supply amount of the heat medium to be supplied to the cooling heat exchanger 14. The cooling capacity is variable by such adjustment.

Meanwhile, the heating unit HU includes a return pipe 23 connected so as to straddle the upstream side and the downstream side of a portion located in the pipe 15 between the compressor 11 and the condenser 12. The above-described heating heat exchanger 21 is connected to this return pipe 23. The heating amount adjustment valve 22 is provided in the return pipe 23 on the downstream side of the heating heat exchanger 21. This configuration enables the heating unit HU to allow a portion of the heat medium flowing out from the compressor 11 toward the condenser 12 to be branched, and enables the portion of the heat medium to return so as to flow into the condenser 12 via the heating heat exchanger 21 and the heating amount adjustment valve 22.

In this heating unit HU, a heat medium in a state of high-temperature and high-pressure gas compressed by the compressor 11 is supplied to the heating heat exchanger 21. As will be described in detail below, the heating heat exchanger 21 heats the liquid by allowing the supplied heat medium to be heat-exchanged with the liquid of the liquid flow apparatus 100. It is possible to adjust the heating capacity of the heating heat exchanger 21 by adjusting the return amount of the heat medium from the heating heat exchanger 21 to the pipe 15 by the heating amount adjustment valve 22. The more the return amount of the heat medium increases, the more the heating capacity increases.

(Liquid Flow Apparatus)

Next, the liquid flow apparatus 100 will be described. As illustrated in FIG. 1, the liquid flow apparatus 100 includes a tank 101 that stores a liquid, and includes a common flow path 102 connected to the tank 100, the common flow path 102 allowing the liquid to flow, and includes a plurality of liquid flow paths 104 branching from the downstream end of the common flow path 102. The liquid stored in the tank 101 may be water or brine. Although not illustrated, the tank 101 in the present embodiment is connected to a pipe for returning the liquid flowing out from the temperature control target to which a liquid is supplied via the liquid flow path 104, to the tank 101. Moreover, the pump 103 drives so as to draw the liquid in the tank 101 to the common flow path 102 side. With this operation, the liquid in the tank 101 is distributed to each of the plurality of liquid flow paths 104 and supplied.

In the present embodiment, the plurality of liquid flow paths 104 includes a first liquid flow path 104A and a second liquid flow path 104B. Among them, the first liquid flow path 104A is connected to the first cooling heat exchanger 14A to enable heat exchange between the liquid allowed to flow and the heat medium flowing through the first cooling heat exchanger 14A. The first liquid flow path 104A is connected to the heating heat exchanger 21 to enable heat exchange between the liquid allowed to flow and the heat medium flowing through the heating heat exchanger 21. In the illustrated example, a connecting portion of the first liquid flow path 104A with the first cooling heat exchanger 14A is located on a more upstream side than the connecting portion with the heating heat exchanger 21.

In the present embodiment, the first liquid flow path 104A includes: a first main flow path 104A1 including a connecting portion with the first cooling heat exchanger 14A and the heating heat exchanger 21, between the upstream end and the downstream end of the first main flow path 104A; and a plurality of first branch flow paths 104A2 to 104A4 branching from the downstream end of the first main flow path 104A1. This makes it possible to supply the liquid temperature-controlled by the first cooling heat exchanger 14A and the heating heat exchanger 21 to a plurality of temperature control targets. Moreover, a first upstream side temperature sensor 31 is provided on the downstream side of the first cooling heat exchanger 14A and on the upstream side of the heating heat exchanger 21, in the first main flow path 104A1. A first downstream side temperature sensor 32 is provided in a portion on the downstream side of the heating heat exchanger 21, in the first main flow path 104A1. The first upstream side temperature sensor 31 and the first downstream side temperature sensor 32 are configured to output temperature information of the detected liquid to the control apparatus 200.

Meanwhile, the second liquid flow path 104B is connected to the second cooling heat exchanger 14B to enable heat exchange between the liquid allowed to flow and the heat medium flowing through the second cooling heat exchanger 14B. Moreover, an electric heater 111 for heating the liquid allowed to flow is provided in the second liquid flow path 104B. Specifically, the second liquid flow path 104B according to the present embodiment includes: a second main flow path 104B1 including a connecting portion with the second cooling heat exchanger 14B, between the upstream end and the downstream end of the second main flow path 104B1; and a plurality of second branch flow paths 104B2 to 104B4 branching from the downstream end of the second main flow path 104B1. The electric heater 111 is constituted with a first electric heater 112, a second electric heater 113, and a third electric heater 114. The first electric heater 112 is provided in the second branch flow path 104B2, the second electric heater 113 is provided in the second branch flow path 104B3, and the third electric heater 114 is provided in the second branch flow path 104B4. This makes it possible to supply the liquid temperature-controlled by the second cooling heat exchanger 14B and the electric heaters 112 to 114 to a plurality of temperature control targets. While the type of the electric heater 111 is not particularly limited, it is preferable to apply a type using resistance heating in consideration of control stability and cost.

Moreover, a second upstream side temperature sensor 33 is provided in a portion on the downstream side of the second cooling heat exchanger 14B, in the second main flow path 104B1. A second downstream side temperature sensor 34 is provided on the downstream side of each of the electric heaters 112 to 114 in the second branch flow paths 104B2 to 104B4. The second upstream side temperature sensor 33 and each of the second downstream side temperature sensors 34 are configured to output detected liquid temperature information to the control apparatus 200.

(Control Apparatus)

Next, the control apparatus 200 will be described. The control apparatus 200 controls the compressor 11, the first expansion valve 13A, the second expansion valve 13B, and the heating amount adjustment valve 22 in the heat medium circulation apparatus 10, while controlling the first to third electric heaters 112 to 114 in the liquid flow apparatus 100. The control apparatus 200 is electrically connected to each of the first upstream side temperature sensor 31, the first downstream side temperature sensor 32, the second upstream side temperature sensor 33, and the second downstream side temperature sensor 34.

The control apparatus 200 is capable of adjusting the rotation speed of the compressor 11 by adjusting the operation frequency of the compressor 11. An increase in the operation frequency of the compressor 11 by the control apparatus 200 leads to an increase in the rotation speed of the compressor 11, making it possible to increase the supply amount of the heat medium to be supplied to the first cooling heat exchanger 14A and the second cooling heat exchanger 14B. This makes it possible to increase the refrigerating capacity. In contrast, a decrease in the operation frequency of the compressor 11 by the control apparatus 200 lead to a decrease in the rotation speed of the compressor 11, making it possible to decrease the supply amount of the heat medium to be supplied to the first cooling heat exchanger 14A and the second cooling heat exchanger 14B. This makes it possible to lower the refrigerating capacity. In the present embodiment, the compressor 11 is operated at a constant rotation speed. This operation suppresses the fluctuation of the refrigerating capacity, making it possible to stabilize the temperature control.

Moreover, the control apparatus 200 is capable of adjusting the opening degree of the first expansion valve 13A and the opening degree of the second expansion valve 13B. The control apparatus 200 is capable of adjusting the opening degree of the first expansion valve 13A and the opening degree of the second expansion valve 13B so as to maintain the pressure of the heat medium flowing out from the first cooling heat exchanger 14A and the second cooling heat exchanger 14B at a desired value, or so as to control the refrigerating capacity of the first cooling heat exchanger 14A and the refrigerating capacity of the second cooling heat exchanger 14B to desired values. In the case of controlling the refrigerating capacity of the first cooling heat exchanger 14A and the refrigerating capacity of the second cooling heat exchanger 14B to desired values, the control apparatus 200 may adjust the opening degree of the first expansion valve 13A on the basis of the temperature information from the first upstream side temperature sensor 31, and may adjust the opening degree of the second expansion valve 13B on the basis of the temperature information from the second upstream side temperature sensor 33.

Moreover, in the present embodiment, the control apparatus 200 controls the first expansion valve 13A via a first pulse converter 201 and controls the second expansion valve 13B via a second pulse converter 202. Each of the first pulse converter 201 and the second pulse converter 202 receives an input of the operation amount calculated by the control apparatus 200, converts the input operation amount into a pulse signal, and outputs the pulse signal to the first expansion valve 13A and the second expansion valve 13B respectively.

Moreover, the control apparatus 200 is capable of adjusting the opening degree of the heating amount adjustment valve 22. An increase in the opening degree of the heating amount adjustment valve 22 by the control apparatus 200 leads to an increase in the supply amount of the heat medium to the heating heat exchanger 21, making it possible to increase the heating capacity. A decrease in the opening degree of the heating amount adjustment valve 22 by the control apparatus 200 leads to a decrease in the supply amount of the heat medium to the heating heat exchanger 21, making it possible to decrease the heating capacity. The control apparatus 200 may adjust the opening degree of the heating amount adjustment valve 22 on the basis of the temperature information from the first downstream side temperature sensor 32. Moreover, in the present embodiment, the control apparatus 200 controls the heating amount adjustment valve 22 via a third pulse converter 203. The third pulse converter 203 receives an input of operation amount calculated by the control apparatus 200, converts the input operation amount into a pulse signal, and outputs the pulse signal to the heating amount adjustment valve 22.

In addition, the control apparatus 200 is capable of individually adjusting the heating amounts of the first to third electric heaters 112 to 114. In the present embodiment, as illustrated in FIG. 1, the control apparatus 200 controls the first electric heater 112 via a first solid state relay 211 and the second electric heater 113 via a second solid state relay 212, and controls the third electric heater 114 via a third solid state relay 213.

(Operation)

Next, operation of the liquid temperature control apparatus 1 will be described. In operation of the liquid temperature control apparatus 1, each of the first branch flow paths 104A2 to 104A4 and each of the second branch flow paths 104B2 to 104B4 in the liquid flow apparatus 100 is initially connected to a desired temperature control target via pipes (not illustrated). Moreover, a pipe for returning the liquid passing through each of the temperature control targets to the tank 101 is connected to the tank 101. Thereafter, the pump 103 in the liquid flow apparatus 100 is driven to allow the liquid to flow. Moreover, the compressor 11 in the heat medium circulation apparatus 10 is driven to circulate the heat medium.

The heat medium discharged from the compressor 11 is condensed in the condenser 12 and then flows into each of the first cooling heat exchanger 14A and the second cooling heat exchanger 14B via each of the expansion valves 13A and 13B, respectively. At this time, a portion of the heat medium discharged from the compressor 11 flows into the heating heat exchanger 21 and then returns to the downstream side of the condenser 12. The heat medium that has flown into each of the first cooling heat exchanger 14A and the second cooling heat exchanger 14B undergoes heat exchange with the liquid of the liquid flow apparatus 100 and then merges with each other and flows into the compressor 11. The heat medium flowing into the compressor 11 is again compressed and discharged.

Moreover, the liquid flow apparatus 100 allows the liquid from the tank 101 to flow through each of the first liquid flow path 104A and the second liquid flow path 104B by the drive of the pump 103. The liquid flowing through the first liquid flow path 104A is cooled by heat exchange with the heat medium flowing through the first cooling heat exchanger 14A. Thereafter, the liquid is heated by heat exchange with the heat medium flowing through the heating heat exchanger 21. At this time, the refrigerating capacity of the first cooling heat exchanger 14A is adjusted to a desired value and the heating capacity of the heating heat exchanger 21 is adjusted to a desired value, thereby temperature of the liquid is controlled to a desired temperature. Thereafter, the liquid flows from the downstream end of the first main flow path 104A1 to each of the first branch flow paths 104A2 to 104A4, and is supplied to the corresponding temperature control target.

The liquid flowing through the second liquid flow path 104B is cooled by heat exchange with the heat medium flowing through the second cooling heat exchanger 14B. Thereafter, this liquid flows to each of the second branch flow paths 104B2 to 104B4, and is heated by the corresponding first to third electric heaters 112 to 114, respectively. Thereafter, the liquid flowing through the second branch flow paths 104B2 to 104B4 is supplied to the corresponding temperature control target. At this time, the refrigerating capacity of the second cooling heat exchanger 14B is adjusted to a desired value and each of the heating capacity of the first to third electric heaters 112 to 114 is adjusted to a desired value, thereby temperature of the liquid is controlled to a desired temperature.

With the liquid temperature control apparatus 1 according to the present embodiment, it is possible to supply a liquid to different temperature control targets from the first liquid flow path 104A and the second liquid flow path 104B. Cooling of the liquid flowing through the second liquid flow path 104B is performed by heat exchange between the liquid and the heat medium flowing through the second cooling heat exchanger 14B of the cooling unit CU, and heating is performed by the electric heaters 112 to 114. Cooling of the liquid flowing through the first liquid flow path 104A is performed by heat exchange between the liquid and the heat medium flowing through the first cooling heat exchanger 14A of the cooling unit CU, and heating is performed by heat exchange between the liquid and a portion of the heat medium heated to a high temperature by the compressor 11 of the cooling unit CU and flowing through the heating heat exchanger 21 of the heating unit HU. The heating capacity of the heating heat exchanger 21 at this time can be adjusted by the heating amount adjustment valve 22. In this configuration, heating is performed by utilizing the amount of heat generated in the cooling unit CU without connecting the heating heat exchanger 21 to a dedicated power supply circuit, leading to suppression of the manufacturing cost and the energy cost. This makes it possible to supply a temperature-controlled liquid to a plurality of temperature control targets while suppressing the manufacturing cost and the energy cost.

In particular, the liquid temperature control apparatus 1 according to the present embodiment performs heating of the liquid flowing through the first liquid flow path 104A by utilizing a portion of the heat medium of the cooling unit CU. Moreover, heating of the liquid flowing through the second liquid flow path 104B is performed by the electric heaters 112 to 114. With this configuration, it is possible to select an application mode, for example, of supplying a liquid from the second liquid flow path 104B for a temperature control target demanding supply of highly accurately temperature-controlled liquid. Accordingly, in a case, for example, where the liquid temperature control apparatus 1 according to the present embodiment is applied to a situation in which there is no need to supply highly accurately temperature-controlled liquid to all the temperature control target, it is possible to particularly effectively suppress the manufacturing cost and the energy cost.

The second liquid flow path 104B includes: the second main flow path 104B1 including a connecting portion with the second cooling heat exchanger 14B; and the plurality of second branch flow paths 104B2 to 104B4 branching from the downstream end of the second main flow path 104B1, and the electric heaters 112 to 114 are provided in each of the plurality of second branch flow paths 104B2 to 104B4, respectively. This makes it possible to supply the liquid to the plurality of temperature control targets from the plurality of second branch flow paths 104B2 to 104B4, leading to achievement of expansion of an application scope of the liquid temperature control apparatus 1.

Moreover, the first liquid flow path 104A includes: the first main flow path 104A1 including a connecting portion with the first cooling heat exchanger 14A and the heating heat exchanger 21; and the plurality of first branch flow paths 104A2 to 104A4 branching from the downstream end of the first main flow path 104A1. This makes it possible to supply a liquid from the plurality of first branch flow paths 104A2 to 104A4 to a plurality of temperature control targets, leading to achievement of expansion of the application scope of the liquid temperature control apparatus 1.

The control apparatus 200 controls the electric heaters 112 to 114 via the solid state relays 211 to 213. This stabilizes the control of the electric heaters 112 to 114 by utilizing the solid state relays 211 to 213, making it possible to perform highly accurate temperature control of the liquid flowing through the second liquid flow path 104B. While in the present embodiment, the control apparatus 200 controls the electric heaters 112 to 114 using the solid state relays 211 to 213, the control apparatus 200 may control the electric heaters 112 to 114 by a relay circuit having contacts.

The first expansion valve 13A in the cooling unit CU is provided on the upstream side of the first cooling heat exchanger 14A, and the second expansion valve 13B is provided on the upstream side of the second cooling heat exchanger 14B. In this case, by separately controlling the expansion valves 13A and 13B corresponding to the first cooling heat exchanger 14A and the second cooling heat exchanger 14B, respectively, it is possible to separately adjust the refrigerating capacity of the first cooling heat exchanger 14A and the second cooling heat exchanger 14B. With this configuration, by separately adjusting the refrigerating capacity of the first cooling heat exchanger 14A and the second cooling heat exchanger 14B in accordance with the temperature of the liquid demanded by the temperature control targets corresponding to the first cooling heat exchanger 14A and the second cooling heat exchanger 14B, it is possible to implement efficient temperature control.

Second Embodiment

Next, a second embodiment of the present invention will be described with reference to FIG. 2. The same reference numerals are given to components similar to those of the first embodiment among the components in the present embodiment, and the description thereof will be omitted.

Figure 2:
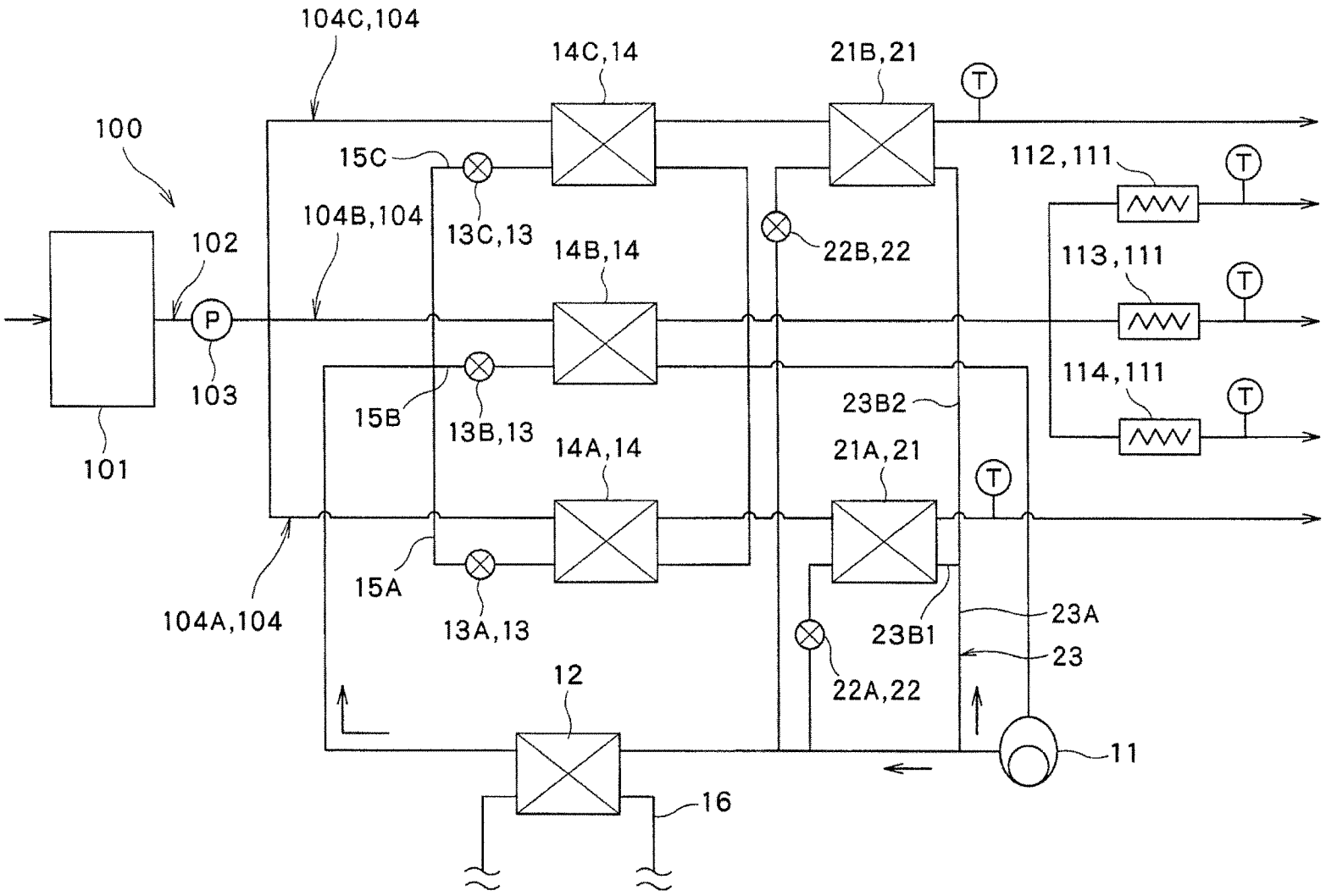
FIG. 2 is a schematic diagram of a liquid temperature control apparatus according to a second embodiment of the present invention.

As illustrated in FIG. 2, in the second embodiment, the return pipe 23 connected to a portion of the pipe 15, located between the compressor 11 and the condenser 12, includes: a main flow path 23A extending from the upstream side of a portion located between the compressor 11 and the condenser 12; and a first sub flow path 23B1 and a second sub flow path 23B2 branching from the downstream end of the main flow path 23A and are connected to the downstream side portions of the connecting position of the main flow path 23A at a position located between the compressor 11 and the condenser 12 in the pipe 15. The heating heat exchanger 21 includes a first heating heat exchanger 21A and a second heating heat exchanger 21B. The heating amount adjustment valve 22 includes a first heating amount adjustment valve 22A and a second heating amount adjustment valve 22B. The first heating heat exchanger 21A is connected to the first sub flow path 23B1 and the second heating heat exchanger 21B is connected to the second sub flow path 23B2. The first heating amount adjustment valve 22A is arranged corresponding to the first heating heat exchanger 21A, while the second heating amount adjustment valve 22B is arranged corresponding to the second heating heat exchanger 21B.

Moreover, the pipe 15 includes a first branch portion 15A, a second branch portion 15B, and a third branch portion 15C, branching into three at the downstream side of the condenser 12 and merging with each other thereafter. The first cooling heat exchanger 14A is connected to the first branch portion 15A, the second cooling heat exchanger 14B is connected to the second branch portion 15B, and the third branch portion 15C is connected to the third cooling heat exchanger 14C. The expansion valve 13 includes the first expansion valve 13A, the second expansion valve 13B, and the third expansion valve 13C. Among these, the first expansion valve 13A is provided in the first branch portion 15A on the upstream side of the first cooling heat exchanger 14A, the second expansion valve 13B is provided in the second branch portion 15B on the upstream side of the second cooling heat exchanger 14B, and the third expansion valve 13C is provided in the third branch portion 15C on the upstream side of the third cooling heat exchanger 14C.

Meanwhile, in the present embodiment, the plurality of liquid flow paths 104 includes the first liquid flow path 104A, the second liquid flow path 104B, and a third liquid flow path 104C. Among them, the first liquid flow path 104A is connected to the first cooling heat exchanger 14A to enable heat exchange between the liquid allowed to flow and the heat medium flowing through the first cooling heat exchanger 14A, while being connected to the first heating heat exchanger 21A to enable heat exchange between the liquid allowed to flow and the heat medium flowing through the first heating heat exchanger 21A.

The second liquid flow path 104B is connected to the second cooling heat exchanger 14B so as to enable heat exchange between the liquid allowed to flow and the heat medium flowing through the second cooling heat exchanger 14B. Moreover, the second liquid flow path 104B includes the electric heater 111 (first to third electric heaters 112 to 114) for heating the liquid allowed to flow. Moreover, the third liquid flow path 104C is connected to the third cooling heat exchanger 14C to enable heat exchange between the liquid allowed to flow and the heat medium flowing through the third cooling heat exchanger 14C, while being connected to the second heating heat exchanger 21B to enable heat exchange between the liquid allowed to flow and the heat medium flowing through the second heating heat exchanger 21B.

In the second embodiment described above, the temperature of the liquid can be controlled by the plurality of heating heat exchangers 21A and 21B and the heating amount adjustment valves 22A and 22B, making it possible to increase the liquid temperature control patterns.

While the embodiments of the present invention have been described above, the present invention is not limited to the above-described embodiments. For example, the number of the cooling heat exchangers 14 and the number of the heating heat exchangers 21 are not limited to the modes of the embodiments described above.

Figure 3:
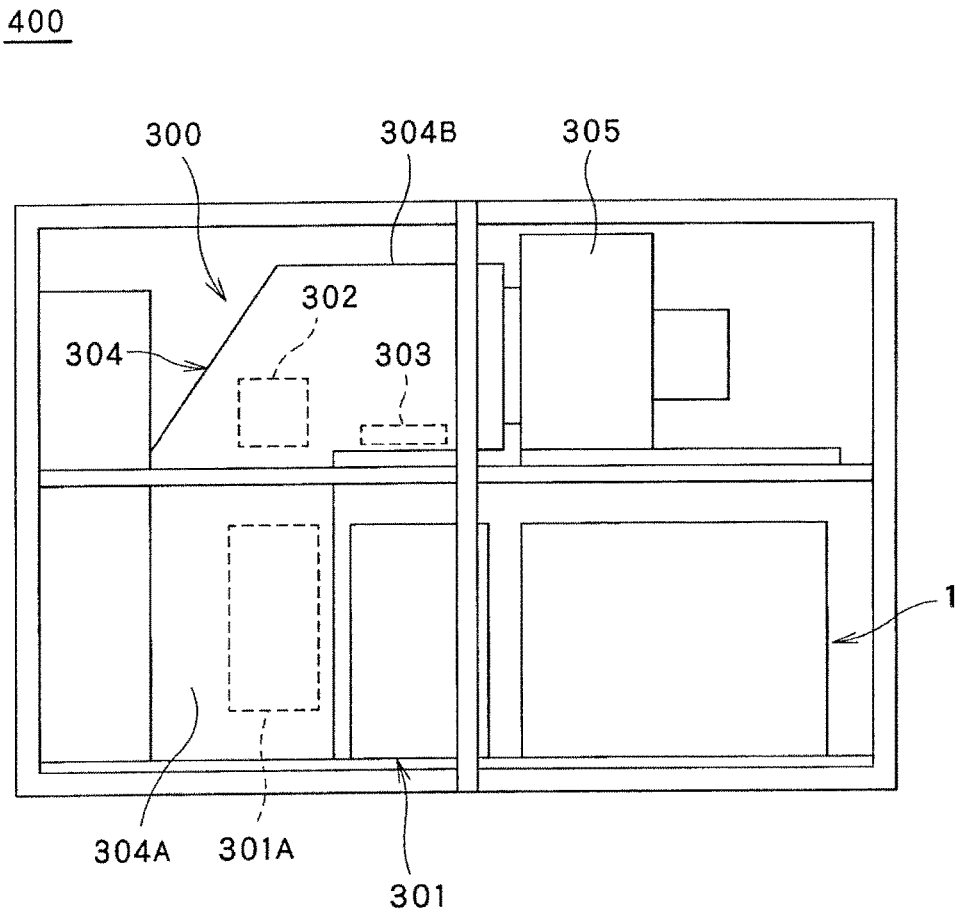
FIG. 3 is a side view of a temperature control system including the liquid temperature control apparatus according to the first or second embodiment and including an air conditioning apparatus.

Moreover, the liquid temperature control apparatus 1 according to each of the above embodiments may be used alone, or may be integrated with an air conditioning apparatus. FIG. 3 is a side view of a temperature control system including the liquid temperature control apparatus 1 according to the first or second embodiment integrated with an air conditioning apparatus 300. The air conditioning apparatus 300 illustrated in FIG. 3 includes: a cooling circuit 301 in which a compressor, a condenser, an expansion valve, and an evaporator 301A are connected in this order by a pipe so as to circulate a heat medium; a heating instrument 302; a humidifier 303; an air flow path 304 containing the evaporator 301A, the heating instrument 302, and the humidifier 303, of the cooling circuit 301; and a blower 305.

The air flow path 304 includes a first flow path 304A extending in the vertical direction and a second flow path 304B communicating with an upper portion of the first flow path 304A and extending in the horizontal direction from the upper portion. The first flow path 304A includes an air intake port. The evaporator 301A of the cooling circuit 301 is arranged at a lower side of the first flow path 304A, and the heating instrument 302 is arranged at an upper side of the first flow path 304A. In addition, the humidifier 303 is arranged in the second flow path 304B. Moreover, the blower 305 is arranged so as to be adjacent to a downstream side end portion of the second flow path 304B in the horizontal direction.

The first flow path 304A extends in the vertical direction and the second flow path 304B extends in the horizontal direction from the upper portion of the first flow path 304A, thereby forming a space on the side of the first flow path 304A and beneath the second flow path 304B. A compressor, a condenser, or the like, of the cooling circuit 301 are arranged in this space. The liquid temperature control apparatus 1 is arranged beneath the blower 305 so as to be adjacent to the compressor, the condenser, or the like, of the cooling circuit 301. Since the air conditioning apparatus 300 and the liquid temperature control apparatus 1 can be arranged efficiently in such a temperature control system, it is possible to suppress enlargement of the overall size. Note that in this temperature control system, similarly to the heating unit HU of the liquid temperature control apparatus 1, the heating instrument 302 may be configured to use a portion of the heat medium flowing out from the compressor to the condenser, or may be an electric heater.

REFERENCE SIGNS LIST

1 . . . Liquid temperature control apparatus
10 . . . Heat medium circulation apparatus
11 . . . Compressor
12 . . . Condenser
13 . . . Expansion valve
13A . . . First expansion valve
13B . . . Second expansion valve
14 . . . Cooling heat exchanger
14A . . . First cooling heat exchanger
14B . . . Second cooling heat exchanger
14C . . . Third cooling heat exchanger
15 . . . Pipe
15A . . . First branch portion
15B . . . Second branch portion
15C . . . Third branch portion
21 . . . Heating heat exchanger
21A . . . First heating heat exchanger
21B . . . Second heating heat exchanger
22 . . . Heating amount adjustment valve
22A . . . First heating amount adjustment valve
22B . . . Second heating amount adjustment valve
23 . . . Return pipe
23A . . . Main flow path
23B1 . . . First sub flow path
23B2 . . . Second sub flow path
CU . . . Cooling unit
HU . . . Heating unit
100 . . . Liquid flow apparatus
104 . . . Liquid flow path
104A . . . First liquid flow path
104A1 . . . First main flow path
104A2 to 104A4 . . . First branch flow path
104B . . . Second liquid flow path
104B1 . . . Second main flow path
104B2 to 104B4 . . . Second branch flow path
104C . . . Third liquid flow path
111 . . . Electric heater
112 . . . First electric heater
113 . . . Second electric heater
114 . . . Third electric heater
200 . . . Control apparatus
211 . . . First solid state relay
212 . . . Second solid state relay
213 . . . Third solid state relay
300 . . . Air conditioning apparatus
400 . . . Temperature control system

The invention claimed is:

1. A liquid temperature control apparatus comprising:

a heat medium circulation apparatus equipped with a cooling unit in which a compressor, a condenser, an expansion valve, and a plurality of cooling heat exchangers are connected by pipes in this order so as to circulate a heat medium, and equipped with a heating unit configured to allow a portion of the heat medium flowing out from the compressor to the condenser to be branched and return the heat medium so as to flow into the condenser on a downstream side of the compressor via a heating heat exchanger and a heating amount adjustment valve; and a liquid flow apparatus including a plurality of liquid flow paths to allow the liquid to flow, wherein a first liquid flow path among the plurality of liquid flow paths is connected to a first cooling heat exchanger so as to enable heat exchange between the liquid allowed to flow and the heat medium that flows through the first cooling heat exchanger among the plurality of cooling heat exchangers, while being connected to the heating heat exchanger so as to enable heat exchange between the liquid allowed to flow and the heat medium that flows through the heating heat exchanger, a second liquid flow path among the plurality of liquid flow paths is connected to a second cooling heat exchanger so as to enable heat exchange between the liquid allowed to flow and the heat medium that flows through the second cooling heat exchanger among the plurality of cooling heat exchangers, and an electric heater for heating the liquid allowed to flow is provided in the second liquid flow path.

2. The liquid temperature control apparatus according to claim 1, wherein the second liquid flow path includes a second main flow path including a connecting portion with the second cooling heat exchanger, between an upstream end and a downstream end of the second main flow path, and includes a plurality of second branch flow paths branching from the downstream end of the second main flow path, and the electric heater is provided in each of the plurality of second branch flow paths.

3. The liquid temperature control apparatus according to claim 1, wherein the first liquid flow path includes a first main flow path including a connecting portion with the first cooling heat exchanger and the heating heat exchanger, between an upstream end and a downstream end of the first main flow path, and includes a plurality of first branch flow paths branching from a downstream end of the first main flow path.

4. The liquid temperature control apparatus according to claim 1, wherein the heating unit includes a plurality of flow paths configured to allow a portion of the heat medium flowing out from the compressor toward the condenser to be branched, and the heating heat exchanger and the heating amount adjustment valve are provided in each of the plurality of flow paths.

5. The liquid temperature control apparatus according to claim 1, further comprising a control apparatus configured to control at least the electric heater, wherein the control apparatus controls the electric heater via a solid state relay.

6. The liquid temperature control apparatus according to claim 1, wherein the expansion valve in the cooling unit is provided on the upstream side of each of the plurality of cooling heat exchangers.

7. A temperature control system comprising: the liquid temperature control apparatus according to claim 1; and an air conditioning apparatus.

* * * * *